US009718275B2

(12) United States Patent
Shimizu

(10) Patent No.: US 9,718,275 B2
(45) Date of Patent: Aug. 1, 2017

(54) LIQUID DISCHARGE APPARATUS

(71) Applicant: Kenji Shimizu, Kanagawa (JP)

(72) Inventor: Kenji Shimizu, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/162,817

(22) Filed: May 24, 2016

(65) Prior Publication Data

US 2016/0339722 A1 Nov. 24, 2016

(30) Foreign Application Priority Data

May 24, 2015 (JP) ..... 2015-105027

(51) Int. Cl.
*B41J 2/175* (2006.01)

(52) U.S. Cl.
CPC ..... *B41J 2/17523* (2013.01); *B41J 2/175* (2013.01); *B41J 2/17509* (2013.01)

(58) Field of Classification Search
CPC ..... B41J 2/17523
See application file for complete search history.

(56) References Cited

U.S. PATENT DOCUMENTS 6,003,981 A * 12/1999 Cameron ..... B41J 2/175 347/85
6,481,838 B1 * 11/2002 Brugue ..... B41J 2/17553 347/85
8,678,568 B2 * 3/2014 Masunaga ..... B41J 2/17509 347/49
2001/0009434 A1 * 7/2001 Sasaki ..... B41J 2/17556 347/94
2012/0050416 A1 * 3/2012 Ishizawa ..... B41J 29/02 347/85
2012/0056936 A1 3/2012 Shimizu et al.
2012/0062649 A1 3/2012 Naruse et al.
2012/0306960 A1 12/2012 Niihara et al.
2012/0306967 A1 12/2012 Shimizu et al.
2012/0306970 A1 12/2012 Naruse et al.
2013/0070022 A1 3/2013 Ogawa et al.
2013/0271527 A1 10/2013 Shimizu
2014/0063123 A1 3/2014 Saiga et al.
2016/0121634 A1 5/2016 Saiga et al.

FOREIGN PATENT DOCUMENTS

JP 2007-190688 8/2007
JP 2014-104635 6/2014

* cited by examiner

*Primary Examiner* — Shelby Fidler
(74) *Attorney, Agent, or Firm* — Cooper & Dunham LLP

(57) ABSTRACT

A liquid discharge apparatus includes a head, a head holder, a carriage, a supply tube, a reference member, a first guide, and a second guide. The supply tube is led out from the carriage and extended to a first side of the head holder opposite a second side of the head holder at which the head holder is hooked on the reference member. The supply tube is disposed in a state in which, in plan view, the supply tube projects from an entry portion of the second guide beyond an end of the head holder in a main scanning direction. At least a portion of the first guide to guide the supply tube is disposed closer to the head holder, in plan view, than a position at which the supply tube projects farthest beyond the end of the head holder in the main scanning direction.

6 Claims, 15 Drawing Sheets

LIQUID DISCHARGE APPARATUS

CROSS-REFERENCE TO RELATED APPLICATION

This patent application is based on and claims priority pursuant to 35 U.S.C. §119(a) to Japanese Patent Application No. 2015-105027, filed on May 24, 2015, in the Japan Patent Office, the entire disclosure of which is hereby incorporated by reference herein.

BACKGROUND

Technical Field

Aspects of this disclosure relate to a liquid discharge apparatus.

Related Art

In a liquid discharge apparatus, when liquid is supplied to a head mounted on a carriage through a supply tuber bendable from an apparatus body side, the position and posture of the carriage are affected by the counterforce or restoration force of the supply tube.

SUMMARY

In an aspect of this disclosure, there is provided a liquid discharge apparatus that includes a head, a head holder, a carriage, a supply tube, a reference member, a first guide, and a second guide. The head discharges liquid. The head holder holds the head. The carriage is movable in a main scanning direction, to hold the head holder. The supply tube feeds liquid from an apparatus body side of the liquid discharge apparatus to the head. The reference member is disposed in the main scanning direction in the carriage. The head holder is hooked on the reference member. The first guide guides the supply tube at a carriage side. The second guide guides the supply tube at a head holder side. The supply tube is led out from the carriage and extended to a first side of the head holder opposite a second side of the head holder at which the head holder is hooked on the reference member. The supply tube is disposed in a state in which, in plan view, the supply tube projects from an entry portion of the second guide beyond an end of the head holder in the main scanning direction. At least a portion of the first guide to guide the supply tube is disposed closer to the head holder, in plan view, than a position at which the supply tube projects farthest beyond the end of the head holder in the main scanning direction.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
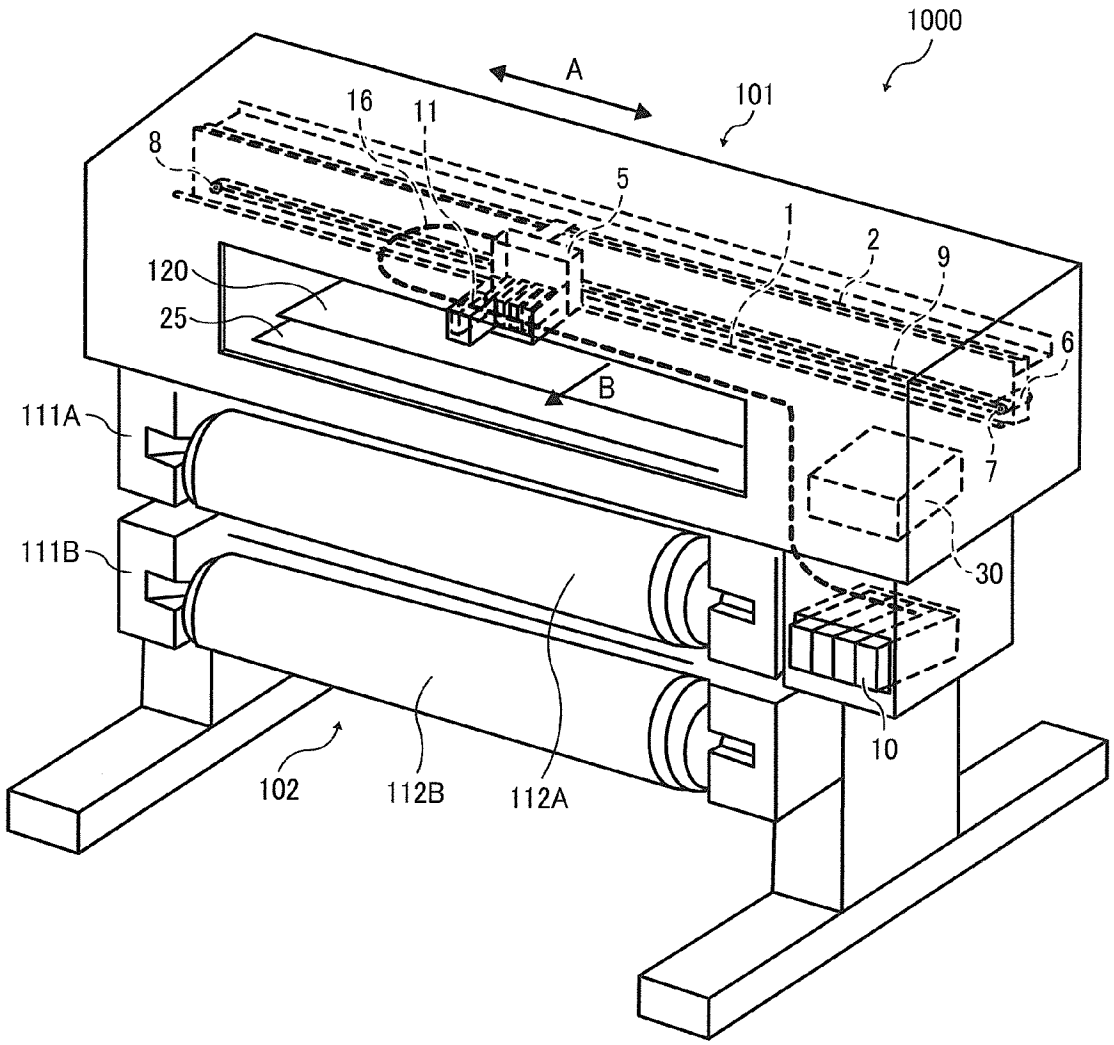
FIG. 1 is a schematic outer perspective view of a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Hereinafter, embodiments of the present disclosure are described with reference to the attached drawings. Referring now to the drawings, wherein like reference numerals designate identical or corresponding parts throughout the several views, exemplary embodiments of the present disclosure are described below.

Figure 2:
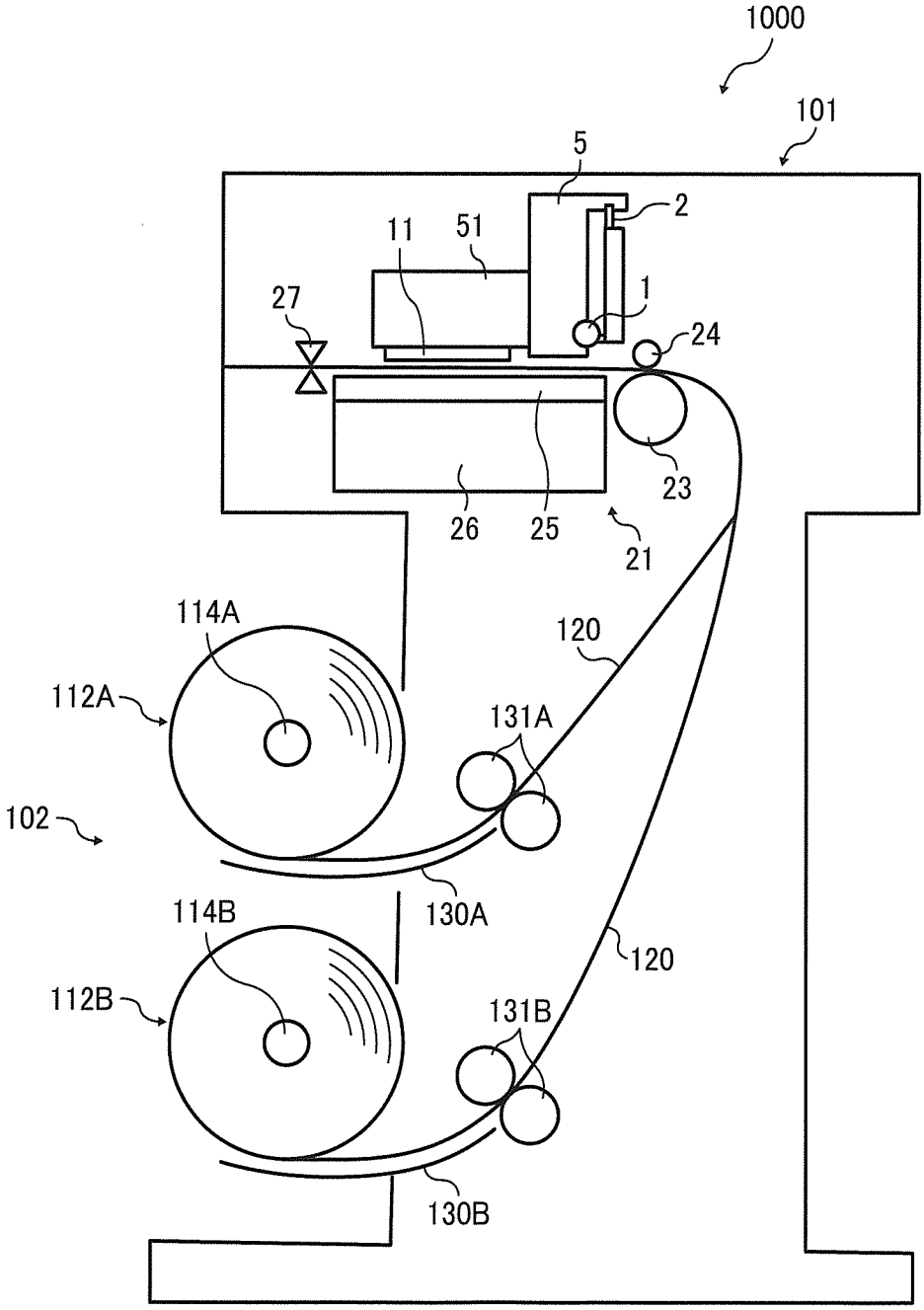
FIG. 2 is a schematic side view of the liquid discharge apparatus of FIG. 1.
Figure 3:
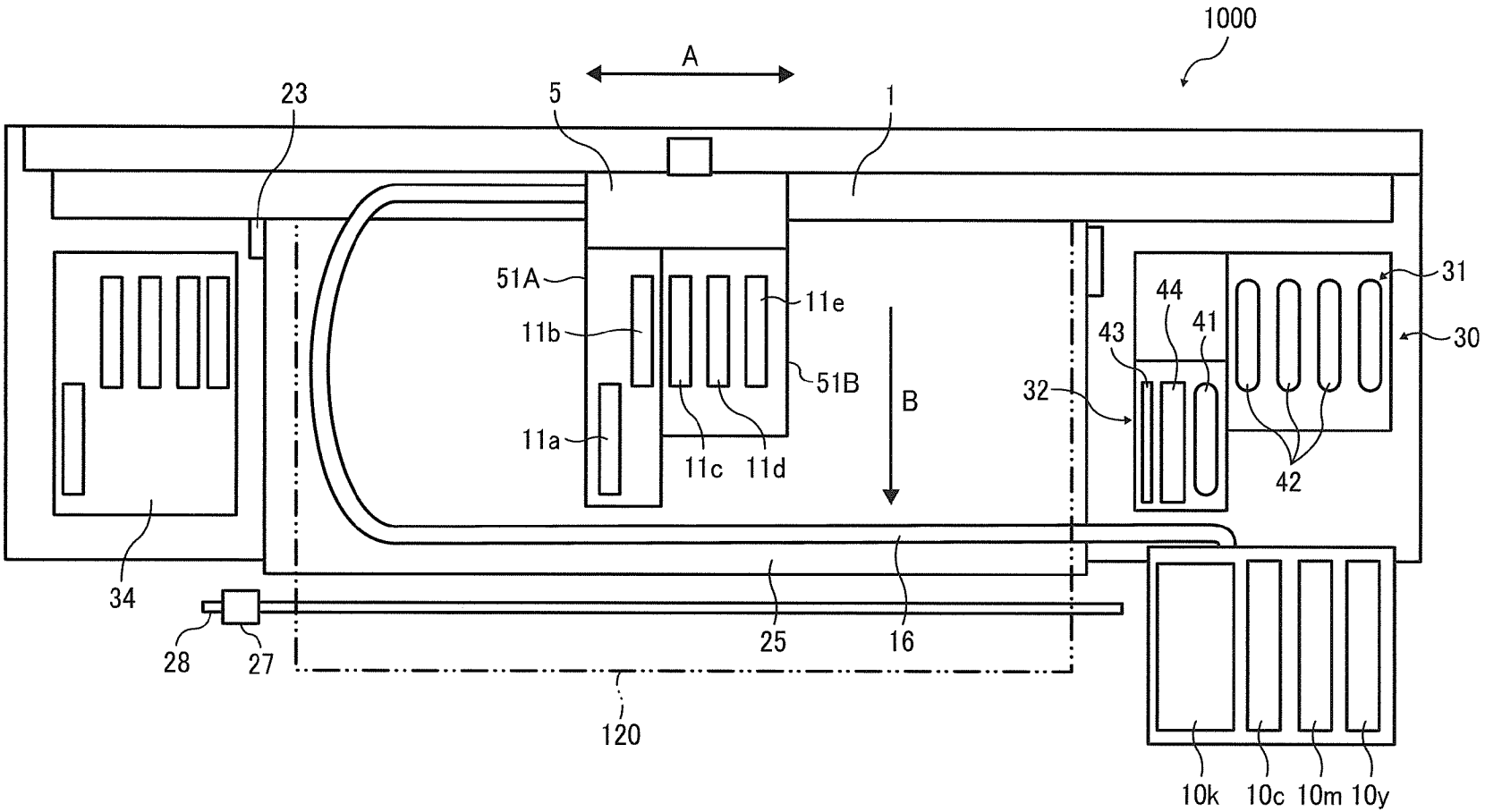
FIG. 3 is a schematic plan view of a mechanical section of the liquid discharge apparatus of FIG. 1.

First, a liquid discharge apparatus 1000 according to an embodiment of this disclosure is described with reference to FIGS. 1 through 3. FIG. 1 is an outer perspective view of the liquid discharge apparatus 1000 according to the present embodiment. FIG. 2 is a schematic side view of the liquid discharge apparatus 1000 of FIG. 1. FIG. 3 is a schematic plan view of a mechanical section of the liquid discharge apparatus 1000 of FIG. 1.

The liquid discharge apparatus 1000 according to the present embodiment is a serial-type liquid discharge apparatus and includes an apparatus body 101 and a sheet feeder 102 disposed below the apparatus body 101. Note that the sheet feeder 102 is disposed below the apparatus body 101 as a separate body from the apparatus body 101. Alternatively, as illustrated in FIG. 2, the sheet feeder 102 may be integrated with the apparatus body 101 as a single unit.

In the apparatus body 101, a carriage 5 is supported on a guide rod 1 and a guide stay 2 as guides to be movable in a direction indicated by arrow A in FIG. 1 (a main scanning direction or a carriage movement direction in FIG. 3). The carriage 5 is moved along the main scanning direction A via a timing belt 9 looped around a drive pulley 7 and a driven pulley 8. The drive pulley 7 is driven and rotated by the main scanning motor 6.

As illustrated in FIG. 3, the carriage 5 mounts heads 11*a* to 11*e* (collectively referred to as "heads 11" unless distinguished). The heads 11 are liquid discharge units in which a plurality of liquid discharge heads (five liquid discharge heads in this example) are integrally molded with a plurality of head tanks to supply liquid to the plurality of liquid discharge heads.

On the carriage 5, the head 11*a* is offset from the heads 11*b* to 11*e* by a distance of one head (one nozzle row) in a sub-scanning direction (indicated by arrow B in FIG. 3) perpendicular to the main scanning direction A. Each of the heads 11*a* to 11*e* has two nozzle rows. Each of the heads 11*a* and 11*b* discharges liquid of the same color, black. The heads 11*c* to 11*e* discharge liquid droplets of magenta (M), cyan (C), and yellow (Y).

Here, liquid colors are allocated to two nozzle rows of the head 11*c*, one nozzle row of the head 11*d*, two nozzle rows of the head 11*e* in an order of Y, M, C, M, Y so that the order in which colors are discharged is identical in both directions in color printing. Accordingly, five supply tubes 16 are disposed at a side at which a head holder 51B is disposed.

Note that the configuration of the heads are not limited to the above-described configuration. For example, a plurality of heads may be all arrayed in line in the main scanning direction A.

Liquid of the respective colors is fed (supplied) to the head tanks of the heads 11 from liquid cartridges 10 (10*k*, 10*c*, 10*m*, and 10*y*) as main tanks replaceably mounted to the apparatus body 101, to the flexible supply tubes 16.

In a recording area of a main scanning region of the carriage 5, a rolled sheet 120 is fed from the sheet feeder 102 and intermittently conveyed by a conveyor 21 in the direction (the scanning direction indicated by arrow B in FIG. 3 or the sheet conveyance direction indicated by arrow B) perpendicular to the main scanning direction A.

The conveyor 21 includes a conveyance roller 23, a pressure roller 24, a conveyance guide 25, and a suction fan 26. The conveyance roller 23 conveys the rolled sheet 120 as a rolled medium fed from the sheet feeder 102. The pressure roller 24 is disposed opposite the conveyance roller 23. The conveyance guide 25 has a plurality of suction holes. The suction fan 26 as a suction device sucks air from the plurality of suction holes of the conveyance guide 25.

As illustrated in FIG. 2, a cutter 27 is disposed downstream from the conveyor 21 in the sheet conveyance direction B. The cutter 27 as a cutting device cuts the rolled sheet 120, on which an image is formed with the heads 11, to a desired length. The cutter 27 moves in the main scanning direction A via a wire or a timing belt 28 to cut the rolled sheet 120 to a desired length.

In the liquid discharge apparatus 1000, a maintenance assembly (maintenance and recovery assembly) 30 is disposed at one side in the main scanning direction A, to maintain and recovery the heads 11. A first dummy discharge receptacle 34 is disposed at the other side in the main scanning direction A, to receive dummy discharge droplets discharged from the heads 11.

The maintenance assembly 30 includes a first maintenance device 31 held by a frame of the apparatus body 101 and a second maintenance device 32 supported by the frame of the apparatus body 101 so as to be reciprocally movable in the sub-scanning direction B. When maintenance operation is performed on the head 11*a*, the second maintenance device 32 is placed at a position illustrated in FIG. 3. When maintenance operation is performed on one of the recording heads 11*b* to 11*e*, the second maintenance device 32 is moved to the same position as the position of the first maintenance device 31 in FIG. 3 in the sub scanning direction B.

The maintenance assembly 30 includes, for example, a suction cap 41 and moisture-retention caps 42 to cap nozzle faces (nozzle formed faces) of the heads 11. The maintenance assembly 30 also includes a wiper 43 to wipe the nozzle faces of the heads 11 and a second dummy ejection receptacle 44 to receive dummy discharge droplets not discharged from the heads 11.

The sheet feeder 102 includes an upper spool bearing stand 111A and a lower spool bearing stand 111B (collectively referred to as "spool bearing stands 111" unless distinguished). In each of the spool bearing stands 111, a reel assembly is disposed to unreel the rolled sheet 120 from a rolled body 112 (112A or 112B) and rewind the rolled sheet 120.

The rolled body 112A and 112B are sheets (hereinafter "rolled sheet") as long rolled media rolled around pipes 114A and 114B, respectively, as core members. Note that the term "rolled body" used herein is a generic name for a combination of the pipe 114 and the rolled sheet 120.

The rolled body 112 mounted on the spool bearing stand 111 is rotated and fed downstream along a guide 130 (130A or 130B) in the sheet conveyance direction. The rolled body 112 is further conveyed by paired conveyance rollers 131 (131A or 131B) to enter between the conveyance roller 23 and the pressure roller 24 of the conveyor 21.

While moving the carriage 5 in the main scanning direction A and intermittently feeding the rolled sheet 120 by the conveyor 21, the liquid discharge apparatus 1000 drives the heads 11 in accordance with image information (print information) to discharge droplets, thus forming an image on the rolled sheet 120. After the image formation, the rolled sheet 120 is cut into a desired length with the cutter 27 and ejected to the front side of the apparatus body 101.

Figure 4:
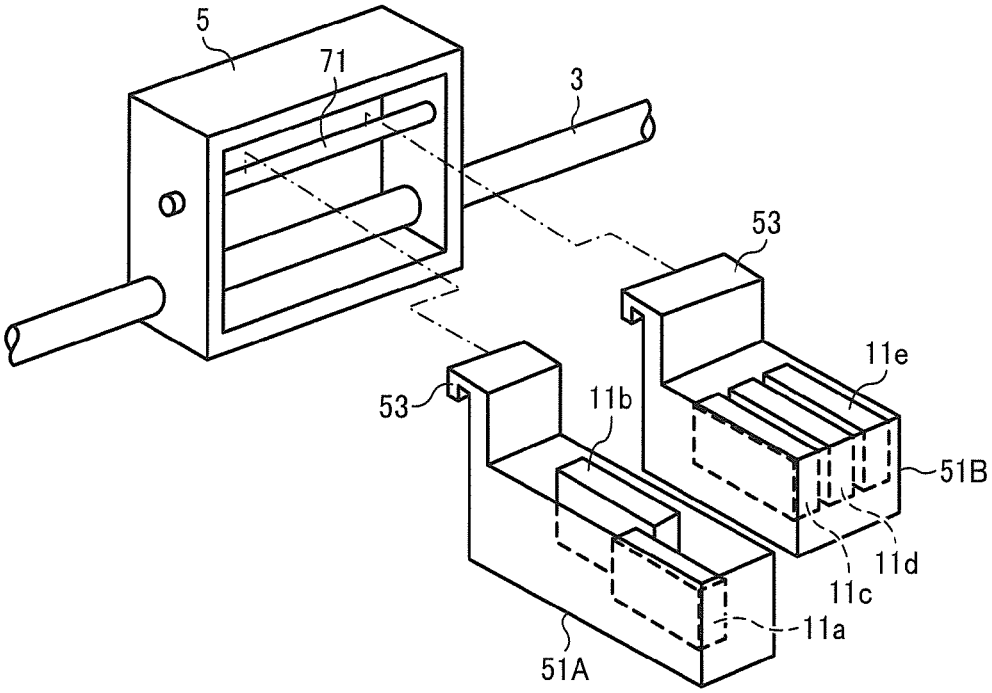
FIG. 4 is a schematic perspective view of a carriage section in a state before a head holder is mounted on a carriage.
Figure 5:
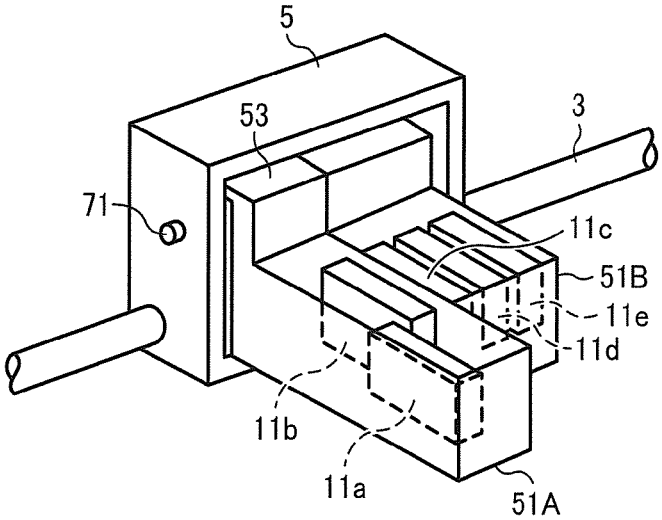
FIG. 5 is a perspective view of the carriage section of FIG. 4 in a state in which the head holder is mounted on the carriage.

Next, a configuration of the carriage of the liquid discharge apparatus according to an embodiment of the present disclosure is described with reference to FIGS. 4 and 5. FIG. 4 is a schematic perspective view of a carriage section in a state before a head holder is mounted on the carriage. FIG. 5 is a perspective view of the carriage section in a state in which the head holder is mounted on the carriage.

The carriage 5 holds a head holder 51A for black and a head holder 51B for other colors than black.

The head holder 51A mounts two heads 11*a* and 11*b* to discharge black to discharge liquid of black. The heads 11*a* and 11*b* are disposed in a staggered manner in the sub-scanning direction B. The head holder 51B mounts three heads 11*c*, 11*d*, and 11*e* to discharge droplets of yellow, magenta, and cyan. The heads 11*c*, 11*d*, and 11*e* are arrayed with the head 11*b* in the main scanning direction A.

Here, the carriage 5 includes a reference shaft 71 as a reference member extending in the same direction as the guide rod 1. Each of the head holders 51 (51A and 51B) includes a hook portion 53 to detachably engage the reference shaft 71. The head holders 51A and 51B are held by the carriage 5 with the hook portions 53 hooked on the reference shaft 71.

Figure 6:
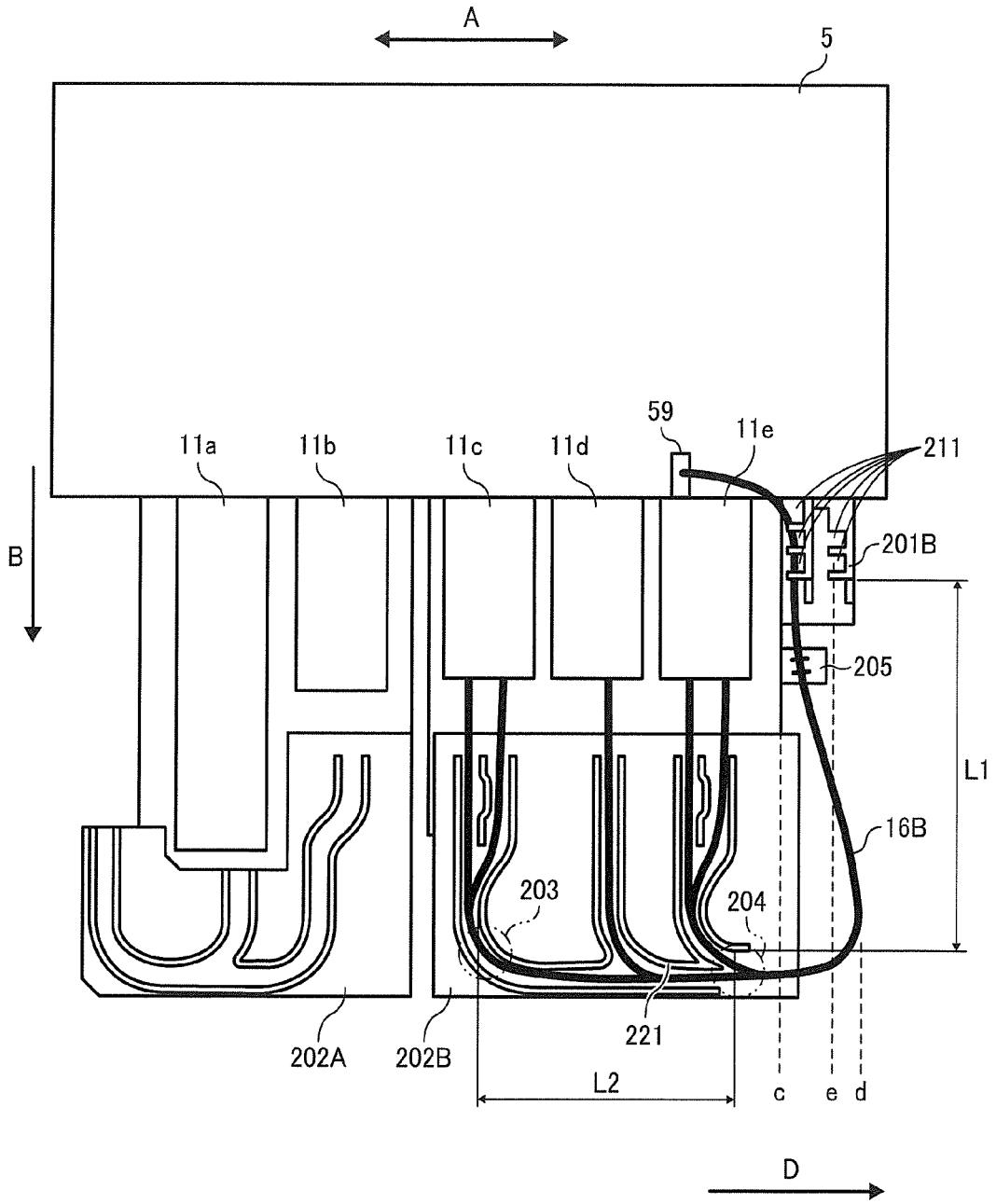
FIG. 6 is a schematic plan view of the carriage section and an arrangement of supply tubes in a first embodiment of the present disclosure.
Figure 7:
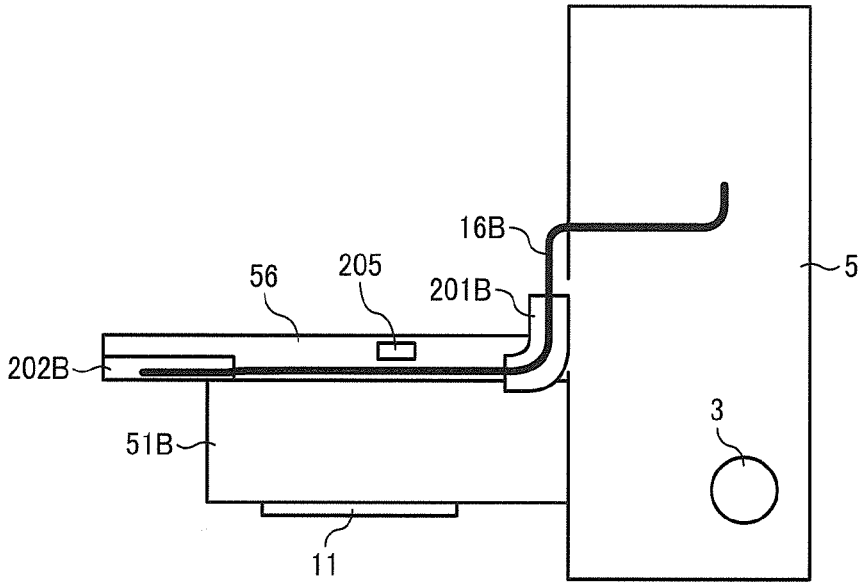
FIG. 7 is a schematic side view of the carriage section of FIG. 6.
Figure 8:
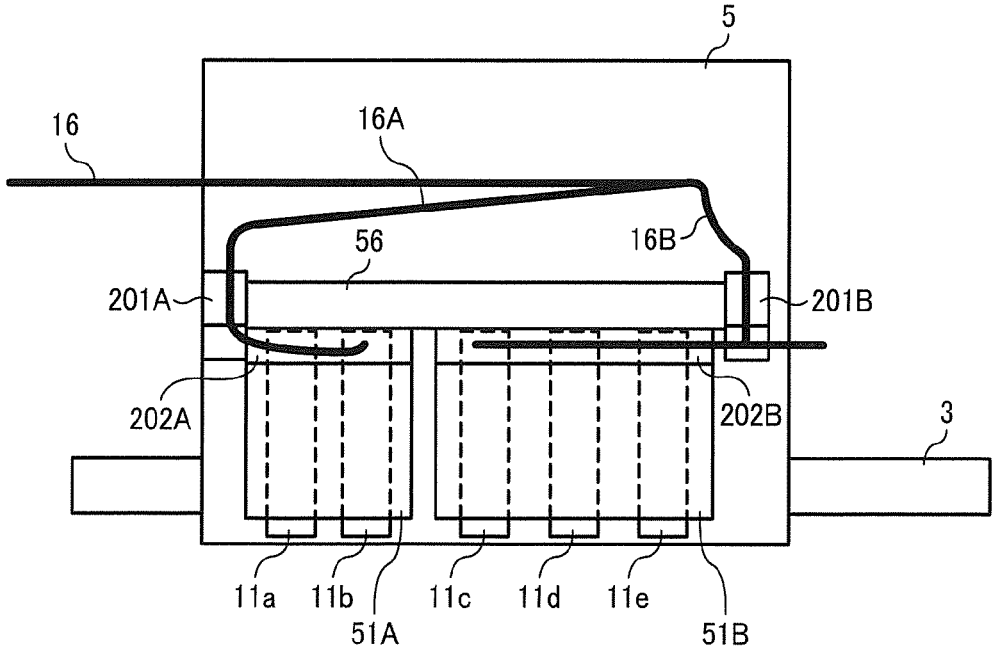
FIG. 8 is a schematic front view of the carriage section of FIG. 6.
Figure 9:
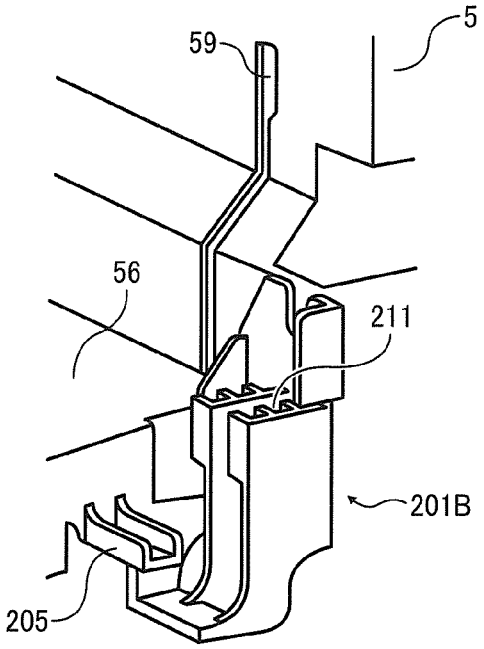
FIG. 9 is a perspective view of a first guide and a surrounding area thereof in the first embodiment.
Figure 10:
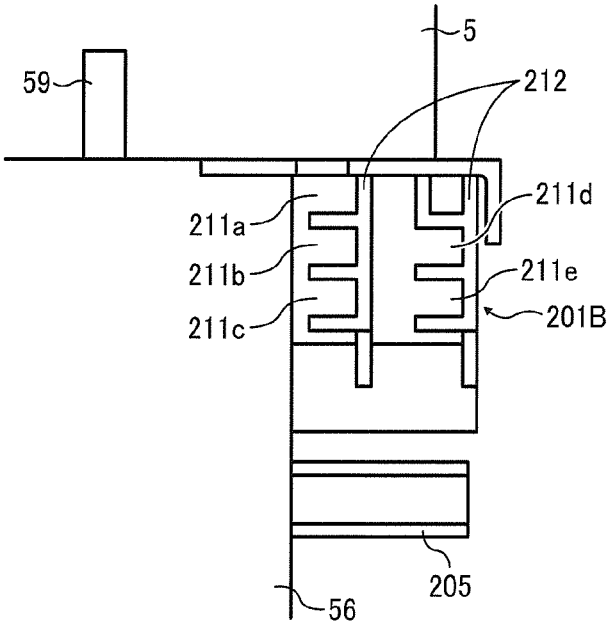
FIG. 10 is a plan view of the first guide and the surrounding area thereof.
Figure 11:
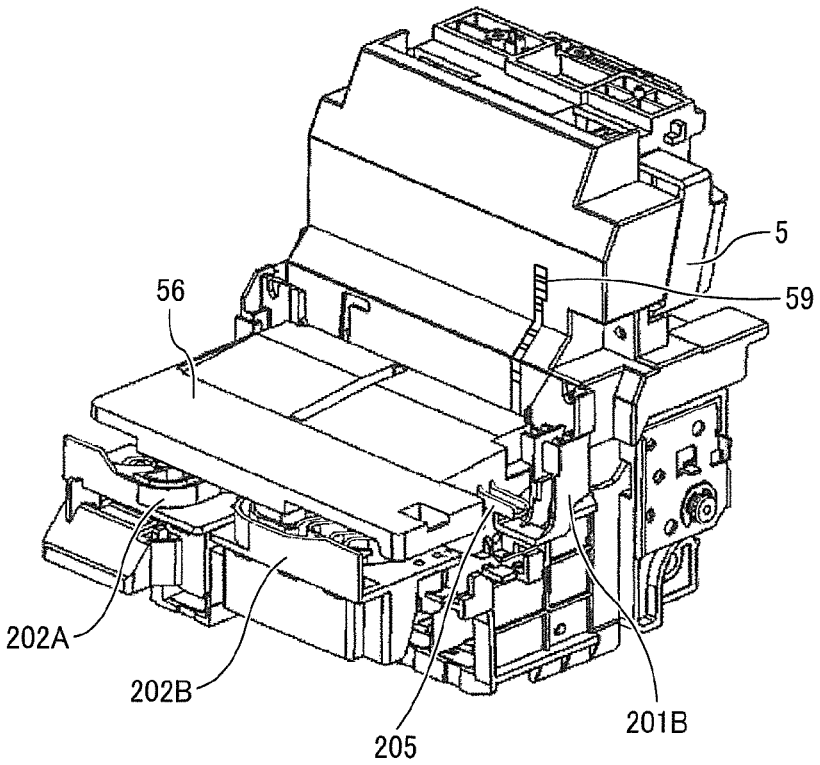
FIG. 11 is a perspective view of the carriage section in the first embodiment.
Figure 12:
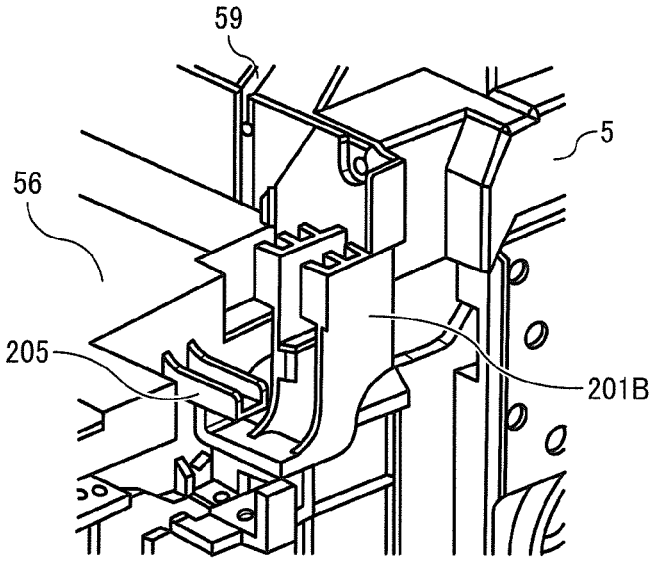
FIG. 12 is an enlarged perspective view of a portion of the carriage section of FIG. 11.
Figure 13:
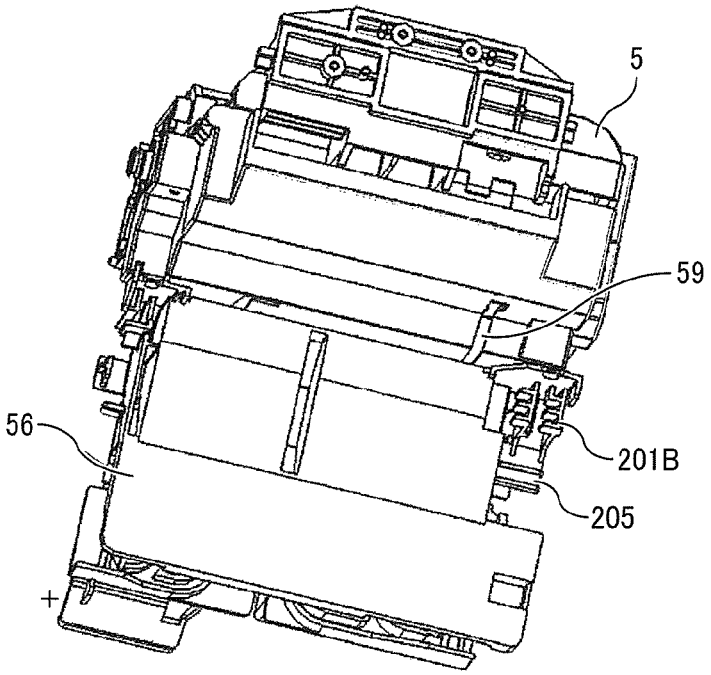
FIG. 13 is a perspective view of the carriage section seen from a direction different from a direction of FIG. 11.
Figure 14:
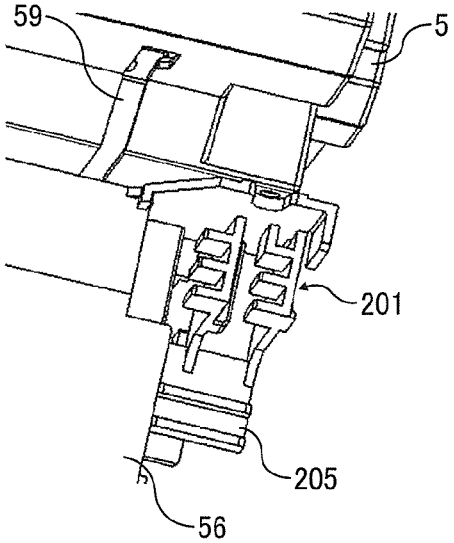
FIG. 14 is an enlarged perspective view of a portion of the carriage section of FIG. 13.
Figure 15:
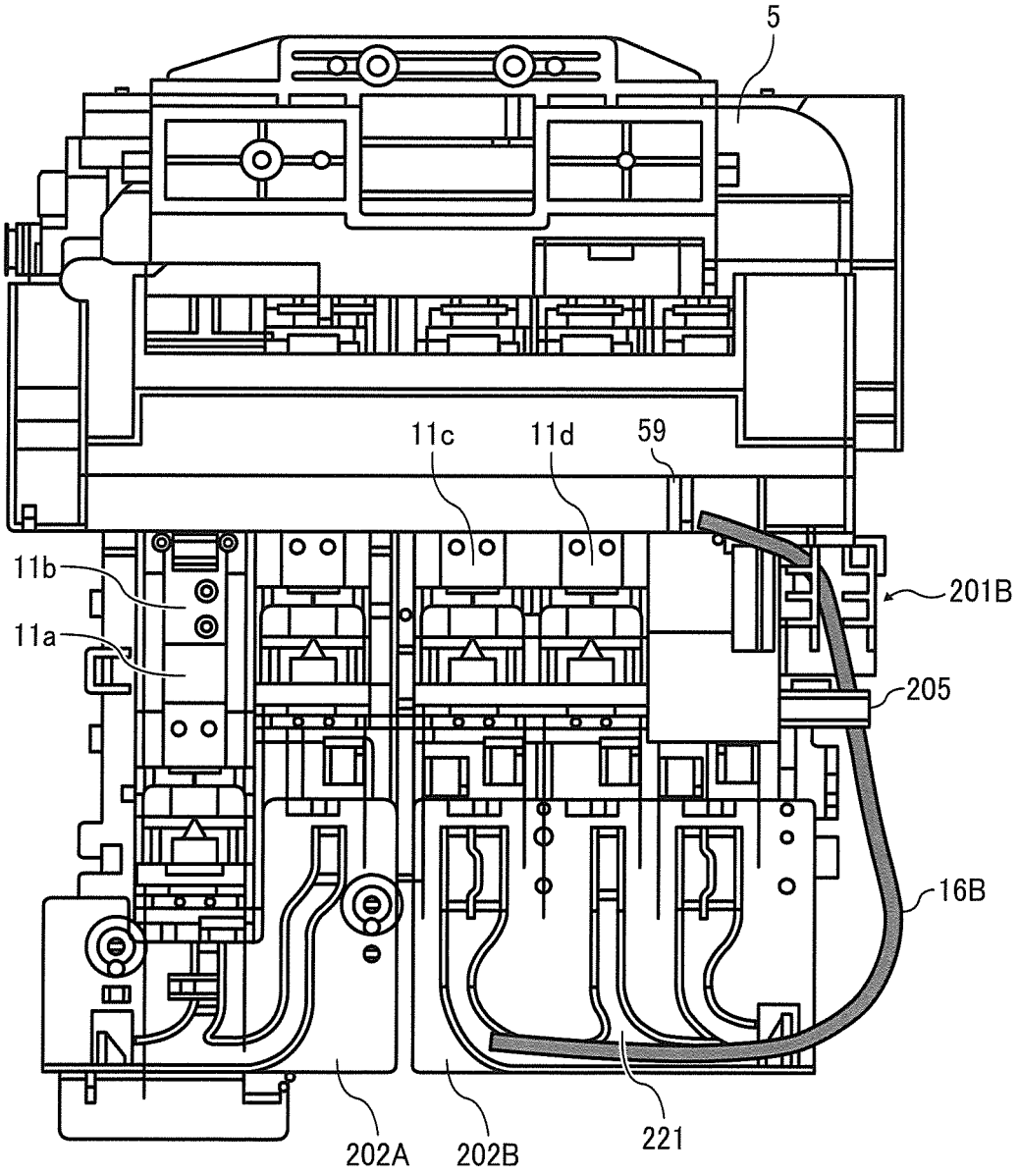
FIG. 15 is a plan view of the carriage section of FIG. 11 in a state in which a holder cover is removed.
Figure 16:
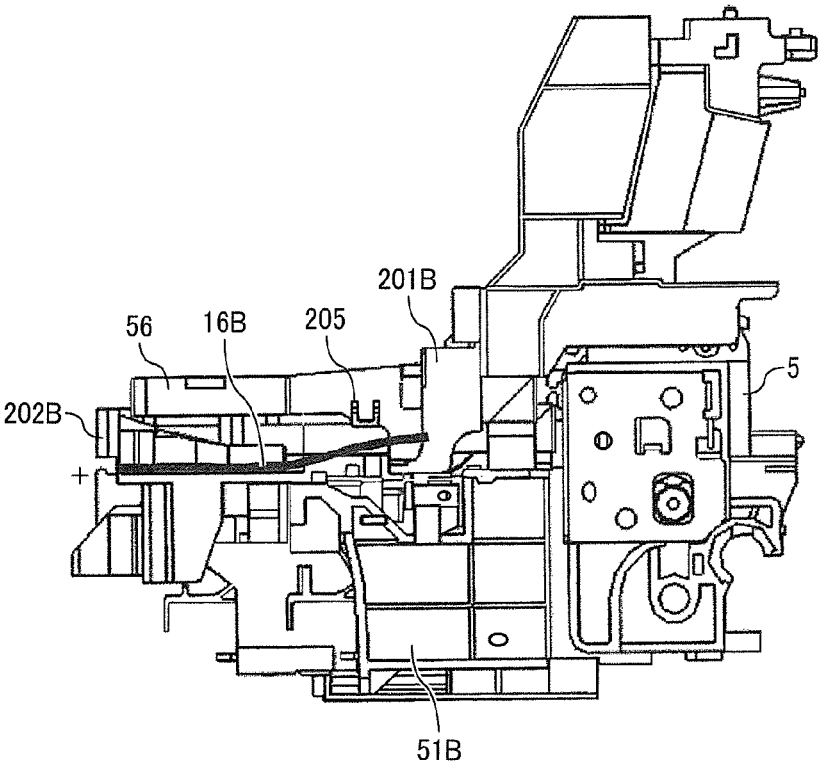
FIG. 16 is a side view of the carriage section of FIG. 11.
Figure 17:
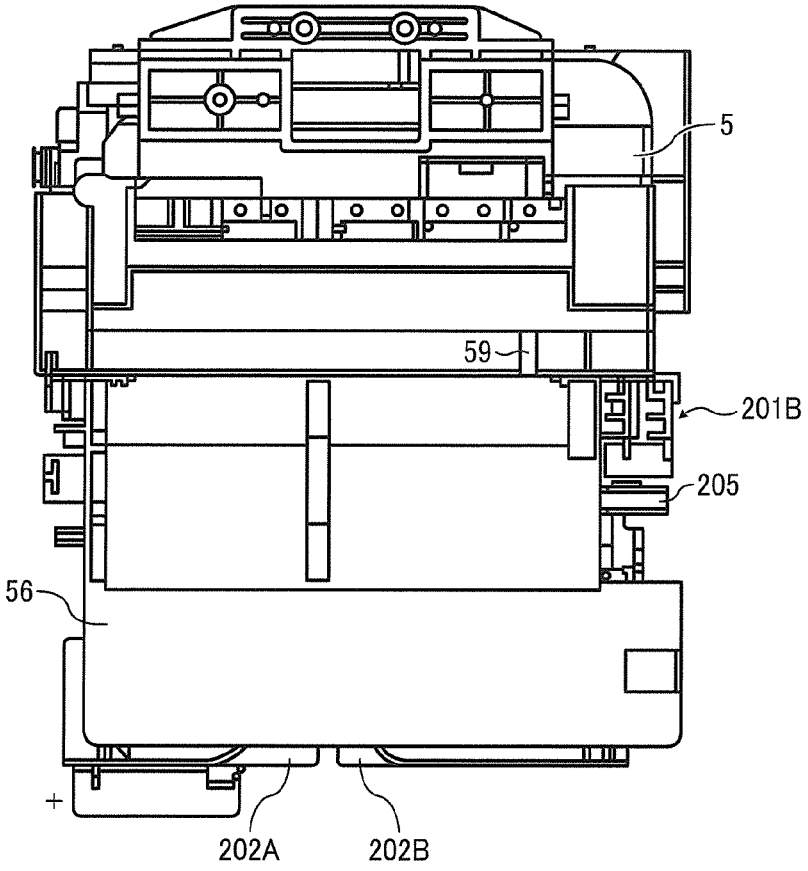
FIG. 17 is a plan view of the carriage section of FIG. 11.
Figure 18:
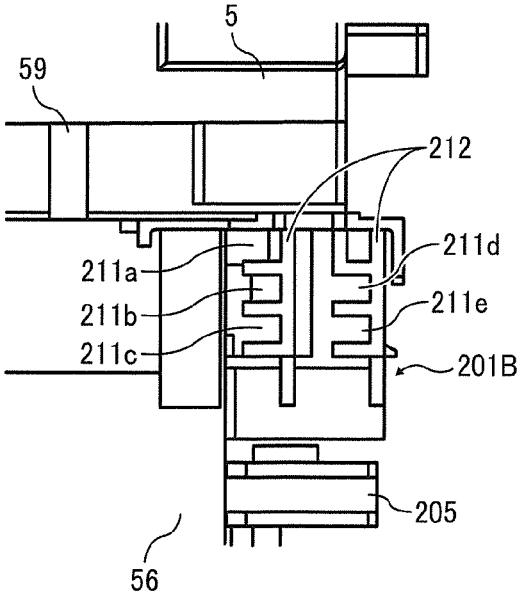
FIG. 18 is an enlarged plan view of a portion of the carriage section of FIG. 17.

Next, a first embodiment of the present disclosure is described with reference to FIGS. 6 through 18. FIG. 6 is a schematic plan view of the carriage section and an arrangement of the supply tubes in the first embodiment. FIG. 7 is a schematic side view of the carriage section of FIG. 6. FIG. 8 is a schematic front view of the carriage section of FIG. 6. FIG. 9 is a perspective view of a first guide and a surrounding area thereof in the first embodiment. FIG. 10 is a plan view of the first guide and the surrounding area thereof. FIG. 11 is a perspective view of the carriage section in the first embodiment. FIG. 12 is an enlarged perspective view of a portion of the carriage section. FIG. 13 is a perspective view of the carriage section seen from a direction different from a direction of FIG. 11. FIG. 14 is an enlarged perspective view of a portion of the carriage section of FIG. 13. FIG. 15 is a plan view of the carriage section in a state in which a holder cover is removed. FIG. 16 is a side view of the carriage section. FIG. 17 is a plan view of the carriage section. FIG. 18 is an enlarged plan view of a portion of the carriage section of FIG. 17.

Note that, in the first embodiment, the supply tubes 16 include two supply tubes 16A for the heads 11*a* and 11*b* and five supply tubes 16B for the heads 11*c* to 11*e*. However, the supply tubes 16A and the supply tubes 16B are collectively illustrated as one line for simplicity of illustration.

The supply tubes 16 each having one end connected to the liquid cartridge 10 are disposed upwardly from one end in the main scanning direction A of the carriage 5 and lead out from a tube outlet 59 of the carriage 5. In such a configuration, the supply tubes 16 guided into the carriage 5 are divided into the supply tubes 16A and the supply tubes 16B inside the carriage 5.

The supply tubes 16 lead out from the carriage 5 are turned downward with respect to the vertical direction and in the direction (the sheet conveyance direction or sub-scanning direction B) perpendicular to the direction of movement of the carriage 5 with respect to the horizontal direction. The supply tubes 16 are further disposed toward the front side of the head holders 51 (i.e., downstream in the sub-scanning direction B) and turned in the main scanning direction A. The supply tubes 16 are further turned in the sub-scanning direction B and connected to the heads 11 of the head holders 51A and 51B.

Here, a guide 201A is mounted on one end of the carriage 5 in the main scanning direction A, to guide the supply tubes 16A. A guide portion 202A to guide the supply tubes 16A is disposed at the head holder 51A. The supply tubes 16A are lead out from a tube outlet of the carriage 5 and guided with the guide 201A to the guide portion 202A of the head holder 51A. The supply tubes 16A are further guided to the heads 11*a* and 11*b*.

On the other end of the carriage 5 in main scanning direction, a first guide portion 201B as a first guide to guide the supply tubes 16B is disposed at one side of a holder cover 56 closer to the carriage 5. The holder cover 56 is disposed above the head holders 51A and 51B to cover the head holders 51A and 51B. A second guide portion 202B as a second guide to guide the supply tubes 16B is disposed at the other side of the holder cover 56 closer to the front side of the head holder 51B.

The supply tubes 16B are lead out from the tube outlet 59 of the carriage 5 (the carriage 5 side) and guided with the first guide portion 201B to the second guide portion 202B and further to the heads 11*c*, 11*d*, and 11*e*.

As illustrated in FIGS. 9 and 10, the first guide portion 201B includes five guide passages 211*a* to 211*e* through which the supply tubes 16B pass. The guide passages 211*a* to 211*e* guide the five supply tubes 16B separately from each other.

Here, openings of the guide passages 211*a* to 211*e* have slightly smaller diameters than diameters of the supply tubes 16A to hold the supply tubes 16 in press-fit manner.

The second guide portion 202B includes a guide groove 221 having ribs as side walls to guide the supply tubes 16, and the guide groove 221 are branched corresponding to the heads 11*c* to 11*e*. No restriction member is disposed at an entry side of the guide groove 221, to restrict the positions of the supply tubes 16B in the main scanning direction A.

As illustrated in FIG. 6, the supply tubes 16B are turned around between the carriage 5 side and the opposite side (i.e., the downstream side in the sub-scanning direction B) of a side at which the head holders 51 are hooked on the reference shaft 71.

The supply tubes 16B are disposed in a state at which, in plan view, the supply tubes 16B project beyond the end of the head holder 51B in the main scanning direction A from an entry portion of the guide groove 221 of the second guide portion 202B. In other words, as illustrated in FIG. 6, the supply tubes 16B are disposed in a state in which, in plan view, the supply tubes 16B project from position c of the end of the head holder 51B to position d of FIG. 6 in the main scanning direction A.

By contrast, the first guide portion 201B is disposed at the carriage 5 side of the holder cover 56. A part (the guide passages 211: position e in FIG. 6) of the first guide portion 201B to guide the supply tubes 16B is disposed, in plan view, at a position closer to the head holder 51B than the position d at which the supply tubes 16B are farthest away from the end of the head holder 51B in the main scanning direction A.

With such a configuration, the turning-around of the supply tubes 16B reduces the counterforce of the supply tubes 16B against the head holder 51B, thus reducing positional variations of the head holder 51B.

Accordingly, the position (posture) of the head holder 51B relative to the head holder 51A, in other words, the positions of the heads 11*c* to 11*e* relative to the heads 11*a* and 11*b* are properly secured, thus preventing a reduction in image quality.

Figure 19:
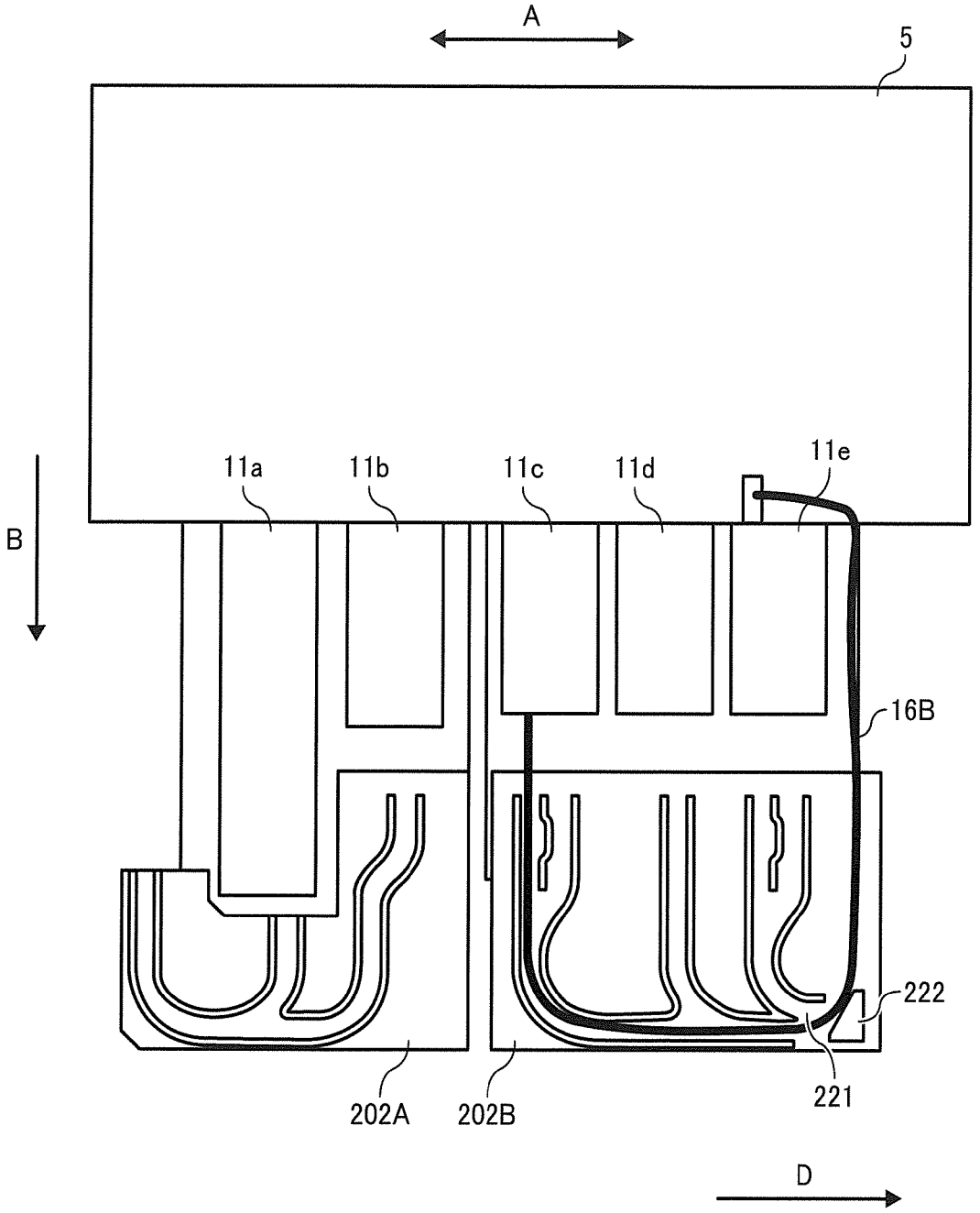
FIG. 19 is a plan view of a comparative example.
Figure 20A:
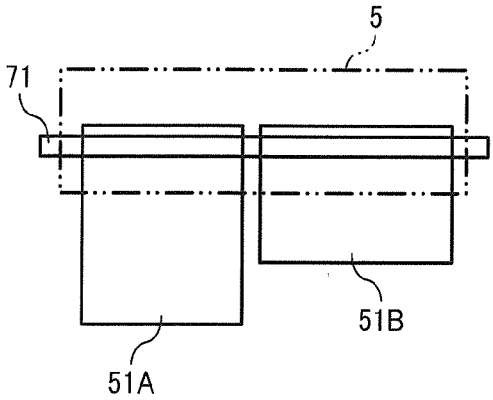
FIGS. 20A and 20B are schematic plan views of head holders of the comparative example of FIG. 19 with an inclined state.
Figure 20B:
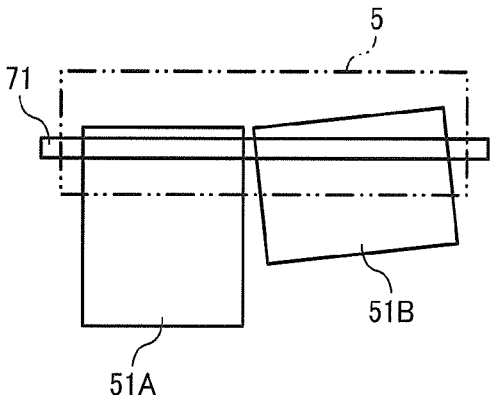

Below, influence of the counterforce of the supply tubes to image quality is described with reference to FIGS. 19, 20A, and 20B. FIG. 19 is a plan view of a comparative example. FIGS. 20A and 20B are schematic plan views of head holders of the comparative example with an inclined state.

In this comparative example, a rib 222 is disposed at an entry portion of the guide groove 221 of the second guide portion 202B, to guide the supply tubes 16B in the sub-scanning direction B and restrict the supply tubes 16B in the main scanning direction A.

As described above, when the supply tubes 16B are turned around to the heads 11, the counterforce of the supply tubes 16B arise.

Here, as in the comparative example, in the configuration in which the rib (wall) 222 is disposed at the entry portion of the second guide portion 202B to restrict movement of the supply tubes 16B in the main scanning direction A, the rib 222 of the head holder 51B receives the counterforce in a direction (tube counterforce direction) indicated by arrow D in FIG. 19.

Accordingly, for the comparative example, as illustrated in FIG. 20B, the counterforce of the supply tubes 16B acts on the head holder 51B to deform the head holder 51B in the tube counterforce direction D, thus inclining the head holder 51B diagonally in plan view.

Consequently, the landing positions of droplets discharged from the heads 11*c* to 11*e* deviate from the landing positions of droplets discharged from the heads 11*a* and 11*b*, thus reducing image quality.

Hence, for the present embodiment, as described above, no rib (wall) is disposed at an end of the entry portion of the guide groove 221 of the second guide portion 202B in the main scanning direction A to guide the supply tubes 16B in the sub-scanning direction B. The supply tubes 16B are projected beyond one end of the head holder 51B in the main scanning direction.

Such a configuration releases the counterforce caused by bending the supply tubes 16B at the entry portion of the guide groove 221 of the second guide portion 202B. In other words, no rib (wall) extending in the sub-scanning direction B is disposed at an end of the entry portion of the guide groove 221 of the second guide portion 202B in the main scanning direction, thus preventing occurrence of the point of action of the counterforce. Such a configuration prevents the head holder 51B from receiving the counterforce in the main scanning direction A, thus reducing the counterforce of the supply tubes 16B against the head holder 51B.

Accordingly, the inclination of the head holder 51B is reduced, thus reducing positional variations due to the counterforce of the supply tubes 16B.

Next, a configuration of the first guide portion 201B is further described below.

As described above, the supply tubes 16B lead out from the tube outlet 59 of the carriage 5 are guided to the second guide portion 202B via the first guide portion 201B.

To secure a space for releasing a counterforce arising between the tube outlet 59 and the second guide portion 202B, the guide passages 211 of the first guide portion 201B are open to the tube outlet 59 in plan view.

For such a configuration, walls 212 (see FIG. 10) at an end of the guide passages 211 in the main scanning direction A restrict the counterforce caused by bending the supply tubes 16B. In other words, the walls 212 restrict the side at which the counterforce of the supply tubes 16B arises, and secures the space for releasing the counterforce of the supply tubes 16B at the carriage 5 side.

The first guide portion 201B includes the guide passages 211 corresponding to the number of the supply tubes 16B. Such a configuration allows the restriction of movement of the supply tubes 16B by fitting the supply tubes 16B in the guide passages 211 one by one, thus preventing an increase of the counterforce due to twist of the supply tubes 16B.

Such a configuration also allows adjustment of the respective lengths of the supply tubes 16B by fitting the supply tubes 16B in the guide passages 211 one by one to restrict the movement of the supply tubes 16B. Such adjustment of the respective lengths of the supply tubes 16B reduces an increase in space due to the projected portion disposed at the second guide portion 202B.

Note that the space for adjusting the lengths of the supply tubes 16B between the tube outlet 59 and the first guide portion 201B increases, but eliminates influences to the liquid discharge apparatus (e.g., the apparatus size and interference with other components). Accordingly, the entire space or the supply tubes 16B are reduced.

The openings of the guide passages 211 of the first guide portion 201B are smaller than the outer diameters of the supply tubes 16B, thus allowing the supply tubes 16 to be press-fitted into the guide passages 211. Such a configuration allows smooth adjustment of the lengths of the supply tubes 16B and prevents the supply tubes 16B from dropping out from the first guide portion 201B during operation and so on.

As illustrated in FIG. 6, the distance L1 between the first guide portion 201B and the second guide portion 202B is longer than the distance L2 between position 203, at which the supply tubes 16B are bent from the head 11*c* side in the main scanning direction A on a path to the head 11*c* farthest from the first guide portion 201B, and position 204, at which the supply tubes 16B are bent from the head 11*e* side in the main scanning direction A on a path to the head 11*e* closest from the first guide portion 201B (L1>L2).

Such a configuration reduces the influence of the counterforce of the supply tubes 16B caused at the first guide portion 201B.

In other words, when the distance L1 between the first guide portion 201B and the second guide portion 202B is relatively short, the distance for easing the counterforce of the supply tubes 16B decreases as in the case for the force generating a bend of a beam. Accordingly, the first guide portion 201B acts as a contact point of the counterforce of the supply tubes 16B, thus causing deformation of the head holder 51B (deformation originated from the first guide portion 201B).

Figure 21:
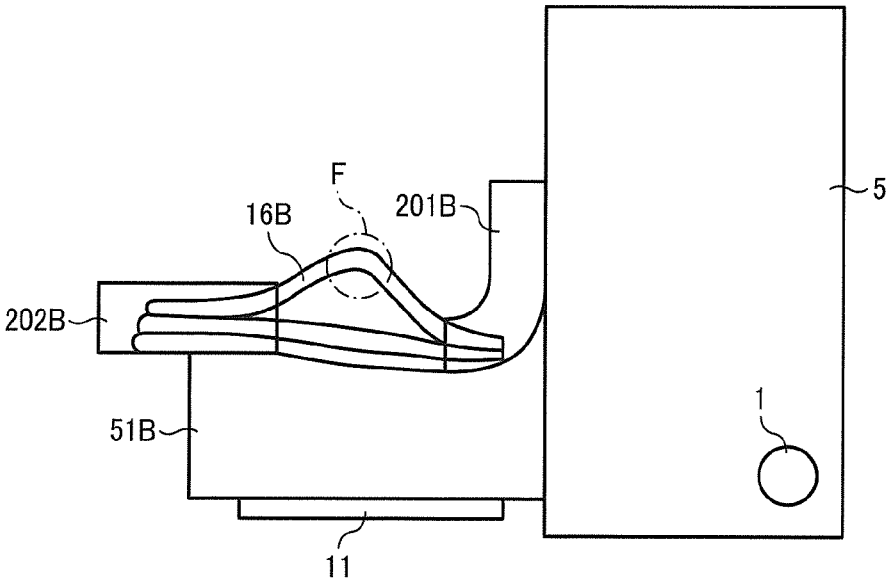
FIG. 21 is a schematic side view of a carriage section with supply tubes according to another comparative example.
Figure 22:
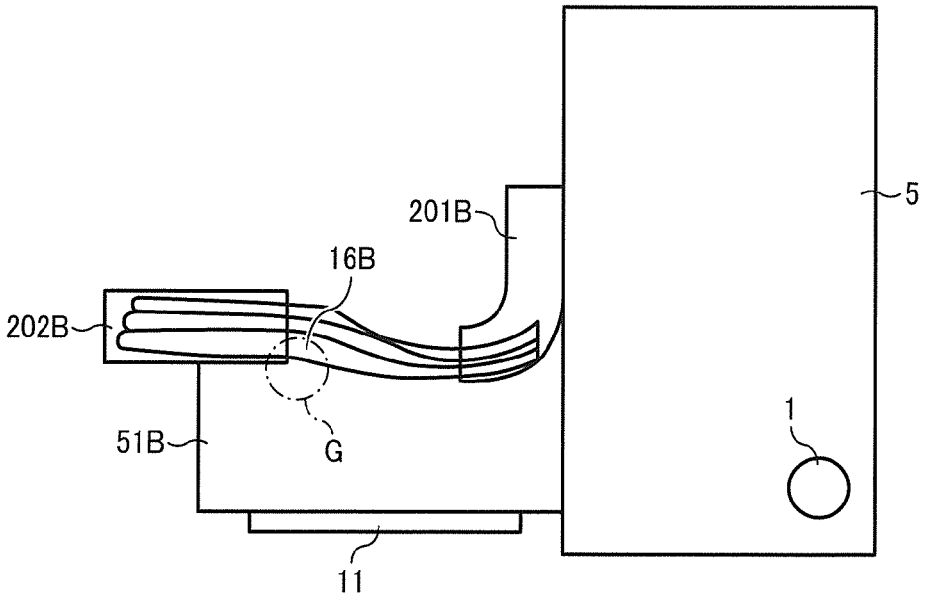
FIG. 22 is a schematic side view of a carriage section with supply tubes according to still another comparative example.

Next, the restriction of the supply tubes 16 in the height direction is described with reference to FIGS. 21 and 22. FIGS. 21 and 22 are schematic side views of the carriage section with the supply tubes 16.

When the number of the supply tubes 16B is two or more, the number of the supply tubes 16B is relatively larger between the first guide portion 201B and the second guide portion 202B. Accordingly, like portion F illustrated in FIG. 21, a portion of the supply tubes 16B might be bent at an area in which the supply tubes 16B is not guided with restriction.

Here, the lengths of the supply tubes 16B are adjusted in the distance from the liquid cartridges 10 at the apparatus body 101 to the heads 11. Therefore, the occurrence of the bending would be caused by overload at other positions. That is, a portion of the supply tubes 16 is short of length, thus causing tensility.

When overload arises at a guided portion to the head holder 51B, though the counterforce of the supply tubes 16 does not so much affect image quality, the overload may cause deformation of the head holder 51B, thus affecting image quality.

Hence, as illustrated in FIGS. 6 and 7, a height restrictor 205 is disposed between the first guide portion 201B and the second guide portion 202B, to restrict the height of the supply tubes 16.

Such a configuration reduces the occurrence of overload.

If the height restrictor 205 is disposed at a position lower than the second guide portion 202B, as illustrated in FIG. 22, a downward load might occur at portion G at which the supply tubes 16B enter the second guide portion 202B.

Hence, the height restrictor 205 is disposed at a position higher than the second guide portion 202B.

In the embodiments of the present invention, the liquid discharge apparatus includes a liquid discharge head or a liquid discharge device, and drives the liquid discharge head to discharge a liquid. The term "liquid discharge apparatus" used herein includes an apparatus capable of discharging liquid onto an object to which liquid can adhere and an apparatus capable of discharging liquid onto liquid or gas.

The liquid discharge apparatus may include devices to feed, convey, and eject the material on which liquid can be adhered. The liquid discharge apparatus may further include a pretreatment apparatus to coat a treatment liquid onto the material, and a post-treatment apparatus to coat a treatment liquid onto the material, onto which the liquid has been discharged.

Examples of the liquid discharge apparatus include an image forming apparatus to form an image on a sheet by discharging ink, and a three-dimensional apparatus to discharge a molding liquid to a powder layer in which powder material is formed in layers, so as to form a three-dimensional article.

In addition, the liquid discharge apparatus is not limited to such an apparatus to form and visualize meaningful images, such as letters or figures, with discharged liquid. For example, the liquid discharge apparatus may be an apparatus to form meaningless images, such as patterns.

The above materials on which the liquid can be deposited may include any material on which the liquid may be deposited even temporarily. Exemplary materials on which the liquid can be deposited may include paper, thread, fiber, fabric, leather, metals, plastics, glass, wood, ceramics, and the like, on which the liquid can be deposited even temporarily.

In addition, the liquid may include ink, a treatment liquid, DNA sample, resist, pattern material, binder, mold liquid, and the like.

Further, the exemplary liquid discharge apparatuses include, otherwise limited in particular, any of a serial-type apparatus to move the liquid discharge head and a line-type apparatus not to move the liquid discharge head.

The pressure generating unit of the liquid discharge head is not limited in particular. For example, other than the piezoelectric actuator (or a layered-type piezoelectric element) as described above, a thermal actuator that employs thermoelectric conversion elements such as a thermal resistor, and an electrostatic actuator formed of a vibration portion and an opposed electrode may be used.

In this disclosure, image formation, recording, and printing are used as synonyms.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge apparatus comprising:

a head to discharge liquid;

a head holder to hold the head;

a carriage movable in a main scanning direction, to hold the head holder;

a supply tube to feed liquid from an apparatus body side of the liquid discharge apparatus to the head;

a reference member disposed in the main scanning direction in the carriage, the head holder hooked on the reference member;

a first guide to guide the supply tube at a carriage side; and a second guide to guide the supply tube at a head holder side, wherein the supply tube is led out from the carriage and extended to a first side of the head holder opposite a second side of the head holder at which the head holder is hooked on the reference member, wherein the supply tube is disposed in a state in which, in plan view, the supply tube projects from an entry portion of the second guide beyond a near end of the head holder in the main scanning direction, and wherein at least a portion of the first guide to guide the supply tube is disposed closer to the head holder, in plan view, than a position at which the supply tube projects farthest beyond the near end of the head holder in the main scanning direction which is closer to the entry portion of the second guide, than to the portion of the first guide that guides the supply tube.

2. The liquid discharge apparatus according to claim 1, wherein the first guide includes a guide passage through which the supply tube passes, and wherein the guide passage has an opening smaller than an outer diameter of the supply tube.

3. The liquid discharge apparatus according to claim 1, wherein the first guide includes a guide passage through which the supply tube passes, wherein the supply tube includes a plurality of tubes, and wherein the guide passage includes a plurality of passages through which the plurality of tubes separately passes.

4. The liquid discharge apparatus according to claim 1, wherein the head holder holds a plurality of heads as the head, and wherein, in plan view, a distance between the first guide and the second guide in a direction perpendicular to the main scanning direction is longer than a distance between a first position, at which the supply tube is bent from the second guide toward a first head, and a second position, at which the supply tube is bent from the second guide toward a second head, wherein a length of the supply tube from the first guide to the first head is longest of the plurality of heads, and wherein a length of the supply tube from the first guide to the second head is shortest of the plurality of heads.

5. The liquid discharge apparatus according to claim 1, further comprising a height restrictor disposed between the first guide and the second guide, to restrict a height of the supply tube.

6. The liquid discharge apparatus according to claim 5, wherein the height restrictor is disposed at a position higher than the second guide.

* * * * *